US007303638B2

(12) United States Patent
Hansen et al.

(10) Patent No.: US 7,303,638 B2
(45) Date of Patent: Dec. 4, 2007

(54) TI 6-2-4-2 SHEET WITH ENHANCED COLD-FORMABILITY

(75) Inventors: James Olaf Hansen, Glastonbury, CT (US); David William Anderson, Cromwell, CT (US)

(73) Assignee: United Technologies Corporation, Hartford, CT (US)

( * ) Notice: Subject to any disclaimer, the term of this patent is extended or adjusted under 35 U.S.C. 154(b) by 444 days.

(21) Appl. No.: 10/847,740

(22) Filed: May 18, 2004

(65) Prior Publication Data

US 2005/0257863 A1 Nov. 24, 2005

(51) Int. Cl.
*C22F 1/16* (2006.01)
*C22C 14/00* (2006.01)

(52) U.S. Cl. ..... 148/670; 148/421

(58) Field of Classification Search ..... 148/670
See application file for complete search history.

(56) References Cited

U.S. PATENT DOCUMENTS 3,169,085 A 2/1965 Newman
3,492,172 A 1/1970 Sauvageot et al.
3,901,743 A 8/1975 Sprague et al.
4,543,132 A 9/1985 Berczik et al.
4,738,822 A * 4/1988 Bania ..... 420/419
5,849,112 A * 12/1998 El-Soudani ..... 148/421

FOREIGN PATENT DOCUMENTS

EP 0 263 503 A1 4/1988

OTHER PUBLICATIONS

Davis et al., The ASM Handbook, Oct. 31, 1990, vol. 2, pp. 614-615 and 619.*
European Search Report dated Sep. 5, 2005.

* cited by examiner

*Primary Examiner*—Roy King
*Assistant Examiner*—Jessee Roe
(74) *Attorney, Agent, or Firm*—Tracy R. Loughlin

(57) ABSTRACT

Systems and methods for enhancing the cold-formability of Ti 6-2-4-2 sheet material are described herein. Embodiments of these methods comprise cold-forming a predetermined, pretreated Ti 6-2-4-2 alloy into a cold-formed shape; subjecting the cold-formed shape to a post-forming annealing cycle comprising: heating the cold-formed shape to about 1450±25 ° F.; holding the cold-formed shape at about 1450±25° F. for about 15±2 minutes; and cooling the cold-formed shape to room temperature. Embodiments of these methods further comprise subjecting the predetermined Ti 6-2-4-2 alloy to a pre-forming annealing cycle comprising: heating the predetermined alloy to a pre-forming annealing temperature of about 1550-1750° F.; holding the predetermined alloy at the pre-forming annealing temperature for about 30 minutes; and cooling the predetermined alloy to room temperature. These methods allow components comprising 90° bend angles, having a bend factor as low as about 6.2 T, to be achieved.

11 Claims, 2 Drawing Sheets

TI 6-2-4-2 SHEET WITH ENHANCED COLD-FORMABILITY

STATEMENT REGARDING FEDERALLY SPONSORED RESEARCH OR DEVELOPMENT

The U.S. Government may have certain rights in this invention pursuant to Contract Number F33657-01-C-1240-001 with the United States Air Force.

FIELD OF THE INVENTION

The present invention relates generally to cold-forming Ti 6-2-4-2 sheet material. More specifically, the present invention relates to methods that enhance the cold-formability of Ti 6-2-4-2 sheet material. Even more specifically, the present invention relates to utilizing Ti 6-2-4-2 sheet material that has been subjected to a duplex annealing process according to AMS 4919, subjecting this sheet to a pre-forming annealing cycle to enhance its cold-formability, cold-forming the sheet into a desired part, and then subjecting the part to a post-forming annealing cycle to restore the microstructure and mechanical properties of the material to their typical AMS 4919 duplex annealed conditions. Alternatively, the Ti 6-2-4-2 sheet material may be received in a single annealed state, where the sheet has been subjected only to the first annealing process of AMS 4919, that sheet could be cold-formed into a desired part, and then that part could be subjected to a post-forming annealing cycle to create the microstructure and mechanical properties in the material that the material would have in its typical AMS 4919 duplex annealed condition.

BACKGROUND OF THE INVENTION

Titanium 6Al-2Sn-4Zr-2Mo sheet material in various thicknesses, also known as Ti 6-2-4-2 sheet, is commercially available in a duplex annealed condition according to AMS 4919 specifications. According to AMS 4919 specifications, Ti 6-2-4-2 sheets under 0.1875 inches (4.762 mm) in nominal thickness are heated to 1650±25° F. (899±14° C.), held there for 30±3 minutes, cooled in air to room temperature, reheated to 1450±25° F. (788±14° C.), held there for 15±2 minutes, and then cooled in air to room temperature. In this condition, Ti 6-2-4-2 sheet is not very cold-formable, and a bend factor (bend diameter/sheet thickness) of about 12-14 T is generally required to reliably produce crack-free components with 90° bend angles.

Ti 6-2-4-2 sheets are commonly utilized to make gas turbine engine components such as nozzle sidewalls, flaps, ducts, cases, brackets, etc. Cold-forming such components from Ti 6-2-4-2 sheet is difficult, and often times, cracks are formed in such parts when they are cold-formed, resulting in poor production yields. Additionally, for successful cold-forming, bend radii need to be very large, which increases the weight of the part and reduces the stiffness thereof. Ti 6-2-4-2 sheet may be hot formed to tighter bend radii, but this requires expensive tooling and chemical milling after forming.

Therefore, it would be desirable to have improved techniques for cold-forming Ti 6-2-4-2 sheet material so that hot forming would not be required. It would also be desirable to have cold-forming techniques that allow better production yields than currently possible to be obtained when cold-forming Ti 6-2-4-2 sheet material. Furthermore, it would be desirable to have techniques that allow Ti 6-2-4-2 sheet components having 90° bend angles and bend factors of less than about 12-14 T to be formed via cold-forming without cracking.

SUMMARY OF THE INVENTION

Accordingly, the above-identified shortcomings of existing Ti 6-2-4-2 sheet cold-forming techniques are overcome by embodiments of the present invention, which relates to systems and methods that enhance the cold-formability of Ti 6-2-4-2 sheet. These systems and methods allow much tighter bend factors to be obtained than currently possible when cold-forming Ti 6-2-4-2 sheet, and also improve the production yields associated with cold-forming such sheet.

Embodiments of this invention comprise methods for enhancing the cold-formability of a predetermined, pre-treated alloy (Ti 6-2-4-2 sheet less than 0.1875 inches thick that has been duplex annealed according to AMS 4919 specifications). These methods comprise subjecting the predetermined alloy to a pre-forming annealing cycle comprising: heating the predetermined alloy to a pre-forming annealing temperature of about 1550-1750° F.; holding the predetermined alloy at the pre-forming annealing temperature for about 30±3 minutes; and cooling the predetermined alloy to room temperature at a first predetermined cooling rate. These methods may further comprise cold-forming the predetermined alloy into a cold-formed shape; and subjecting the cold-formed shape to a post-forming annealing cycle comprising: heating the cold-formed shape to about 1450±25° F.; holding the cold-formed shape at about 1450±25° F. for about 15±2 minutes; and cooling the cold-formed shape to room temperature at a second predetermined cooling rate.

Other embodiments of this invention comprise methods for enhancing the cold-formability of a predetermined, pre-treated alloy (Ti 6-2-4-2 sheet less than 0.1875 inches thick that has been singly annealed at about 1650±25° F. for about 30±3 minutes, and then cooled in air to room temperature). These methods may comprise cold-forming the predetermined alloy into a cold-formed shape; and subjecting the cold-formed shape to a post-forming annealing cycle comprising: heating the cold-formed shape to about 1450±25° F.; holding the cold-formed shape at about 1450±25° F. for about 15±2 minutes; and cooling the cold-formed shape to room temperature at a predetermined cooling rate.

In all embodiments of this invention, the cold-formed shape, after being subjected to the post-forming annealing cycle, comprises a microstructure substantially similar to a microstructure of standard Ti 6-2-4-2 sheet that has been duplex annealed according to AMS 4919 specifications. Furthermore, the cold-formed shape, after being subjected to the post-forming annealing cycle, comprises mechanical properties substantially equivalent to mechanical properties of standard Ti 6-2-4-2 sheet that has been duplex annealed according to AMS 4919 specifications.

The cold-formed shapes of this invention can be cold-formed to a final, permanent 90° bend angle having a bend factor below about 12-14 T. Bend factors as low as about 6.2 T or lower are possible. These cold-formed shapes may comprise a gas turbine engine component, such as, for example, a nozzle sidewall, a flap, a duct, a case, a bracket, etc.

The enhanced cold-formable Ti 6-2-4-2 sheets of this invention may comprise a higher volume percent of beta phase therein than standard Ti 6-2-4-2 sheet that has been heat treated according to AMS 4919 specifications. These enhanced cold-formable Ti 6-2-4-2 sheets may comprise as much as about 18-40 percent more beta phase therein by volume than standard Ti 6-2-4-2 sheet that has been heat treated according to AMS 4919 specifications.

The enhanced cold-formable Ti 6-2-4-2 sheets of this invention may comprise less fine $\alpha_2$ and/or less silicides than in standard Ti 6-2-4-2 sheet that has been heat treated according to AMS 4919 specifications.

Embodiments of this invention comprise products made by the processes described above.

Further features, aspects and advantages of the present invention will be readily apparent to those skilled in the art during the course of the following description, wherein references are made to the accompanying figures which illustrate some preferred forms of the present invention, and wherein like characters of reference designate like parts throughout the drawings.

DESCRIPTION OF THE DRAWINGS

The systems and methods of the present invention are described herein below with reference to various figures, in which.

DETAILED DESCRIPTION OF THE INVENTION

Figure 1:
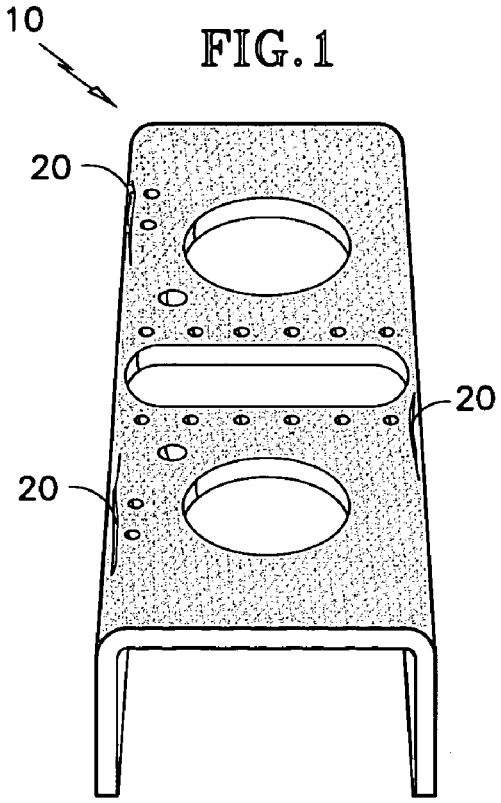
FIG. 1 is a photograph showing an exemplary bracket made of Ti 6-2-4-2 sheet, showing the cracks that are typically created when such sheet is duplex annealed according to AMS 4919 specifications and then cold-formed in the as-received condition.
Figure 2:
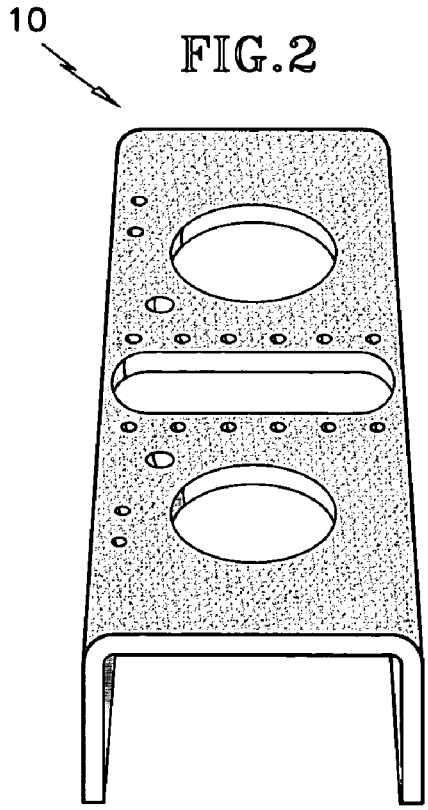
FIG. 2 is a photograph showing an exemplary bracket made of Ti 6-2-4-2 sheet, showing that no cracks are created when such sheet is duplex annealed according to AMS 4919 specifications, and then further subjected to a pre-forming annealing cycle of this invention, prior to being cold-formed.
Figure 3:
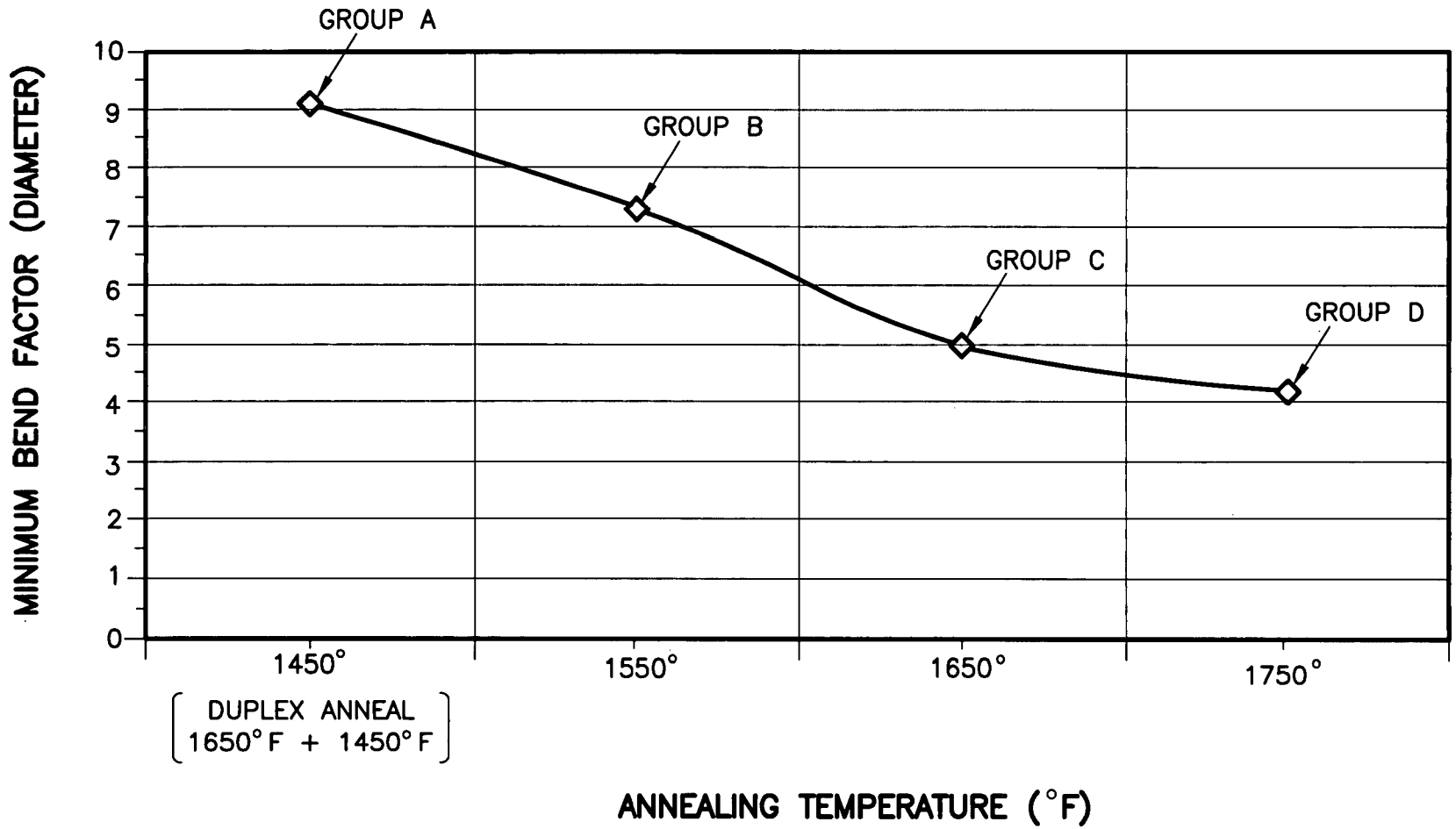
FIG. 3 is a graph showing the effect of the annealing temperature on the formability of the Ti 6-2-4-2 sheet after it is duplex annealed according to AMS 4919 specifications, subjected to pre-forming annealing at the temperatures indicated on the graph, and then cold-formed per ASTM E 290 (105° bend angle), as observed in embodiments of this invention.

For the purposes of promoting an understanding of the invention, reference will now be made to some preferred embodiments of this invention as illustrated in FIGS. 1-3 and specific language used to describe the same. The terminology used herein is for the purpose of description, not limitation. Specific structural and functional details disclosed herein are not to be interpreted as limiting, but merely as a basis for the claims as a representative basis for teaching one skilled in the art to variously employ the present invention. Any modifications or variations in the depicted structures and methods, and such further applications of the principles of the invention as illustrated herein, as would normally occur to one skilled in the art, are considered to be within the spirit and scope of this invention.

This invention relates to systems and methods that enhance the cold-formability of Ti 6-2-4-2 sheet material. These systems and methods may allow production yields of up to 100% percent to be achieved when cold-forming Ti 6-2-4-2 sheet into parts comprising 90° bend angles and having a bend factor as low as about 6.2 T. As used herein and throughout, "bend factor" is defined as the bend diameter divided by the sheet thickness.

Titanium generally has a hexagonal closed-packed (HCP) lattice structure below about 1625° F. (885° C.). However, at about 1625° F. (885° C.), titanium undergoes an allotropic transformation, changing from a HCP lattice structure to a body-centered cubic (BCC) lattice structure. The HCP lattice structure form of titanium is known as the alpha phase, and the BCC lattice structure form of titanium is known as the beta phase. Most titanium alloys now in use comprise various proportions of alpha and beta phases.

The allotropic transformation temperature, also known as the beta transus temperature, is affected by the amount and type of impurities in the titanium or by the alloying elements that are added thereto. Adding alpha stabilizing alloying elements (i.e., aluminum) to titanium stabilizes the alpha phase and raises the allotropic transformation temperature. Adding beta stabilizing alloying elements (i.e., molybdenum, chromium, vanadium) to titanium stabilizes the beta phase and lowers the allotropic transformation temperature. The beta phase of titanium can be made stable at or below room temperature by adding large amounts of beta stabilizers.

Ti 6-2-4-2 sheet material typically comprises about 5.50-6.50 wt. % aluminum, 3.60-4.40 wt. % zirconium, 1.80-2.20 wt. % molybdenum, 1.80-2.20 wt. % tin, 0.06-0.10 wt. % silicon, up to 0.25 wt. % iron, up to 0.12 wt. % oxygen, up to 0.05 wt. % carbon, up to 0.05 wt. % nitrogen, up to 0.0150 wt. % hydrogen, and up to 0.005 wt. % yttrium, with the balance comprising titanium and residual elements.

As previously noted, Ti 6-2-4-2 sheet material in various thicknesses is commercially available in a duplex annealed condition according to AMS 4919 specifications. In this duplex annealed condition, Ti 6-2-4-2 sheet is not very cold-formable, and a bend factor of about 12-14 T or greater is generally required to reliably produce crack-free components having 90° bend angles. If components with 90° bend angles and bend factors less than about 12-14 T are attempted with these sheets in their typical duplex annealed condition, undesirable cracking of the component often occurs. This invention allows bend factors significantly less than 12-14 T to be obtained when cold-forming these Ti 6-2-4-2 sheet materials into 90° bend angles.

The photograph in FIG. 1 shows an exemplary part 10 made of Ti 6-2-4-2 sheet, showing the cracks 20 that are typically created when such sheet is duplex annealed according to AMS 4919 specifications and then cold-formed in its as-received condition. FIG. 2 shows a part 10 that was made from the same heat of Ti 6-2-4-2 sheet material as the part in FIG. 1. However, the part in FIG. 2 was first subjected to pre-forming annealing according to embodiments of this invention, was then cold-formed, and was then subjected to post-forming annealing according to embodiments of this invention. As seen in FIG. 2, the Ti 6-2-4-2 sheet that was thermally treated according to methods of this invention does not have any cracks in the 90° bend angle portions thereof. The parts 10 shown in FIGS. 1 and 2 have a bend radius of 0.188", a sheet metal thickness of 0.035", and a bend factor of 10.7 T.

Embodiments of this invention utilize Ti 6-2-4-2 sheet that has been subjected, by the sheet supplier, to the standard duplex annealing process of the AMS 4919 specification described above. This Ti 6-2-4-2 sheet, if under 0.1875 inches (4.762 mm) in nominal thickness, was heated to about 1650±25° F. (899±14° C.), held there for about 30±3 minutes, cooled in air to room temperature, reheated to about 1450±25° F. (788±14° C.), held there for about 15±2 minutes, and then cooled in air to room temperature. The first annealing cycle recrystallizes and/or normalizes the hot rolled structure of the Ti 6-2-4-2 sheet, while the second annealing cycle sets the final microstructure and strengthens the Ti 6-2-4-2 sheet. To enhance the cold-formability of this duplex annealed Ti 6-2-4-2 sheet, the sheet, as received and before being formed, is subjected to a pre-forming annealing cycle according to this invention. This pre-forming annealing cycle comprises heating the sheet to about 1550-1750° F. (843-954° C.), holding the sheet at that temperature for about 30±3 minutes, and then cooling the sheet to room temperature. The sheet may be cooled to room temperature at any suitable rate, such as for example, at about 35° F./min. Thereafter, the sheet can be more readily cold-formed into a variety of shapes, even into shapes comprising 90° bend angles and having bend factors as low as about 4.2 T. Once formed, this cold-formed part can then be subjected to a post-forming annealing cycle, which comprises heating the part to about 1450±25° F. (788±14° C.), holding the part at that temperature for about 15±2 minutes, and then cooling the part to room temperature. The sheet may again be cooled to room temperature at any suitable rate, such as for example, at about 35° F./min. This post-forming annealing cycle restores the microstructure, as well as the strength and other mechanical properties, of the cold-formed part to those of the typical AMS 4919 duplex annealed sheet material.

In alternative embodiments of this invention, the Ti 6-2-4-2 sheet may be received from the supplier in a single annealed state. Instead of being duplex annealed according the AMS 4919 specifications described above, this sheet, if under 0.1875 inches in nominal thickness, will only have been heated to about 1650±25° F. (899±14° C.), held at that temperature for about 30±3 minutes, and then cooled in air to room temperature. Sheet in this condition can be easily cold-formed into a variety of shapes, even into shapes comprising 90° bend angles and having bend factors as low as about 6.2 T. Once formed, this cold-formed part can then be subjected to a post-forming anneal cycle, which comprises heating the part to about 1450±25° F. (788±14° C.), holding the part at that temperature for about 15±2 minutes, and then cooling the part to room temperature at any suitable rate, such as for example, at about 35° F./min. This post-forming annealing cycle sets the final microstructure, thereby creating the strength and other mechanical properties in the cold-formed part that the sheet material would have in its typical AMS 4919 duplex annealed condition.

Bend tests verified the enhanced cold-formability of Ti 6-2-4-2 sheet material subjected to a pre-forming annealing cycle of this invention. Initial bend test samples were cut from a single sheet of 0.030" thick Ti 6-2-4-2 AMS 4919 sheet material. All samples were cut in the same orientation so as not to introduce variability due to differences in the bend direction with respect to the rolled direction of the sheet material. Four groups of samples were created. Group A samples were left in their as-received AMS 4919 duplex annealed condition. The remaining samples were wrapped in titanium foil and vacuum heat-treated as follows. Group B samples were heated to about 1550° F. (843° C.), held at that temperature for about 30 minutes, and then argon quenched to room temperature. Group C samples were heated to about 1650° F. (899° C.), held at that temperature for about 30 minutes, and then argon quenched to room temperature. Group D samples were heated to about 1750° F. (954° C.), held at that temperature for about 30 minutes, and then argon quenched to room temperature.

Bend tests were then conducted on the four groups of samples according to ASTM E 290 (105° bend angle) to determine the minimum bend factors at which the materials would start to crack. The results of these bend tests are shown in FIG. 3. There was a large difference in the results depending upon the thermal conditioning the samples had been subjected to. As shown in FIG. 3, the Group A samples exhibited the poorest cold-formability, exhibiting a minimum bend factor of about 9.1 T before cracking. As also shown, cold-formability improved with increasing annealing temperatures, with the samples of Group B exhibiting a minimum bend factor of about 7.3 T, the samples of Group C exhibiting a minimum bend factor of about 5.0 T, and the samples of Group D exhibiting a minimum bend factor of about 4.2 T, before cracking.

Based on the positive results of the initial bend tests, additional bend tests were performed using three different gauges/heats of Ti 6-2-4-2 sheet material to better quantify the benefits of utilizing a pre-forming annealing cycle comprising heating the sheet to about 1650° F. (899° C.), holding it at that temperature for about 30 minutes, and then argon quenching the sheet to room temperature.

Sheets of 0.025", 0.035" and 0.040" thick standard duplex annealed Ti 6-24-2 AMS 4919 material were vacuum annealed at about 1650° F. (899° C.) for about 30 minutes, and were then argon quenched to room temperature. Small bracket-type details were then cut from each of these annealed sheets. Bend tests were then performed on each group of samples to determine the minimum bend factors at which the materials would start to crack. Components such as nozzle sidewall details are typically formed of Ti 6-2-4-2 AMS 4919 sheet with stainless steel backing material to help minimize cracking. Experience suggests that, if no stainless steel backing material is used when cold-forming Ti 6-2-4-2 AMS 4919 sheet, cracks will appear in components having 90° bend angles and a bend factor of about 12-14 T or less. The samples annealed according to this invention were cold-formed on an Amada break press to produce 90° as-formed bends. The samples annealed according to embodiments of this invention could be formed, without cracking and without using stainless steel backing material, to final, permanent 90° bend angles having a bend factor of as low as about 6.2 T, as shown in Table I below. Once a minimum bend factor was determined in one direction, additional samples were formed in the perpendicular direction to ensure repeatability.

TABLE I

| Sheet Thickness (inches) | Orientation | Punch Radius (inches) | Bend Factor (diameter) | Results |
|---|---|---|---|---|
| 0.025 | Transverse | 0.188 | 18.7 | No Cracks |
| 0.025 | Transverse | 0.156 | 15.0 | No Cracks |
| 0.025 | Transverse | 0.125 | 12.5 | No Cracks |
| 0.025 | Transverse | 0.094 | 10.0 | No Cracks |
| 0.025 | Transverse | 0.078 | 8.7 | No Cracks |
| 0.025 | Longitudinal | 0.078 | 8.7 | No Cracks |
| 0.035 | Transverse | 0.188 | 13.4 | No Cracks |
| 0.035 | Transverse | 0.156 | 10.7 | No Cracks |
| 0.035 | Transverse | 0.125 | 8.9 | No Cracks |
| 0.035 | Transverse | 0.094 | 7.1 | No Cracks |
| 0.035 | Transverse | 0.078 | 6.2 | No Cracks |
| 0.035 | Longitudinal | 0.094 | 7.1 | No Cracks |
| 0.035 | Longitudinal | 0.078 | 6.2 | Cracked |
| 0.040 | Transverse | 0.188 | 11.7 | No Cracks |
| 0.040 | Transverse | 0.156 | 9.4 | No Cracks |
| 0.040 | Transverse | 0.125 | 7.8 | No Cracks |
| 0.040 | Transverse | 0.094 | 6.3 | No Cracks |
| 0.040 | Transverse | 0.078 | 5.5 | Cracked |
| 0.040 | Longitudinal | 0.094 | 6.3 | No Cracks |
| 0.040 | Longitudinal | 0.094 | 6.3 | Cracked |
| 0.040 | Longitudinal | 0.078 | 5.5 | Cracked |

Testing has shown that duplex annealed Ti 6-2-4-2 AMS 4919 sheet material that has been subjected to a pre-forming anneal cycle at either 1550° F. or 1650° F., held at that temperature for about 30 minutes, cooled, and then cold-formed, recovers baseline properties when subjected to a post-forming annealing cycle at about 1450° F. for about 15 minutes, which is the normal stress relieving anneal cycle of AMS 4919 specifications.

The enhanced cold-formable Ti 6-2-4-2 sheet materials that have been thermally treated according to the methods of this invention comprise a primary alpha phase therein that has less fine $\alpha_2$ and/or less silicides than in standard Ti 6-2-4-2 sheet material that has been heat treated (i.e. duplex annealed) according to AMS 4919 specifications. The enhanced cold-formable Ti 6-2-4-2 sheet materials that have been thermally treated according to the methods of this invention also comprise higher volume fractions of beta phase therein than standard Ti 6-2-4-2 sheet material that has been heat treated according to AMS 4919 specifications. The volume fraction of beta phase was measured on the various groups of samples at 2000× magnification, and the results are summarized in Table II.

TABLE II

| Sample Groups | Volume fraction beta phase |
|---|---|
| Group A | 13.2% |
| Group B | 15.6% |
| Group C | 16.5% |
| Group D | 18.5% |

As described above, this invention provides systems and methods that enhance the cold-formability of Ti 6-2-4-2 sheet material. Advantageously, the enhanced cold-formability of the Ti 6-24-2 sheets of this invention may eliminate the need to have expensive hot-forming equipment. Additionally, the Ti 6-24-2 sheets of this invention can be formed to a tighter bend radius than currently possible with other cold-forming techniques, thereby increasing the stiffness of the cold-formed part. This allows parts formed from the Ti 6-2-4-2 sheets of this invention to replace parts formed from heavier and lower strength cold-formable beta Ti alloys, and may even eliminate the need to use heavier cold-formable nickel-based alloys. Many other embodiments and advantages will be apparent to those skilled in the relevant art.

Various embodiments of this invention have been described in fulfillment of the various needs that the invention meets. It should be recognized that these embodiments are merely illustrative of the principles of various embodiments of the present invention. Numerous modifications and adaptations thereof will be apparent to those skilled in the art without departing from the spirit and scope of the present invention. For example, while some examples described herein were argon quenched, air cooling is also possible. Thus, it is intended that the present invention cover all suitable modifications and variations as come within the scope of the appended claims and their equivalents.

What is claimed is:

1. A method for cold forming a Ti 6-2-4-2 sheet, comprising:

providing a Ti 6-2-4-2 sheet having a nominal thickness of less than about 0.1875 inches that has been duplex annealed according to AMS 4919 by heating the Ti 6-2-4-2 sheet to about 1650 ±25° F., holding the Ti 6-2-4-2 sheet at about 1650±25° F. for about 30±3 minutes, and cooling the Ti 6-2-4-2 sheet to room temperature in air, reheating the Ti 6-2-4-2 sheet to about 1450±25° F., holding the Ti 6-2-4-2 sheet at about 1450±25° F. for about 15±2 minutes, and cooling the Ti 6-2-4-2 sheet to room temperature in air;

subjecting the Ti 6-2-4-2 sheet to a pre-forming annealing cycle comprising:

heating the Ti 6-2-4-2 sheet to a pre-forming annealing temperature of about 1550-1750° F.;

holding the Ti 6-2-4-2 sheet at the pre-forming annealing temperature for about 30 minutes; and cooling the Ti 6-2-4-2 sheet to room temperature at a first predetermined cooling rate;

cold-forming the Ti 6-2-4-2 sheet into a cold-formed shape; and subjecting the cold-formed shape to a post-forming annealing cycle comprising:

heating the cold-formed shape to about 1450±25° F.;

holding the cold-formed shape at about 1450±25° F. for about 15±2 minutes; and cooling the cold-formed shape to room temperature at a second predetermined cooling rate.

2. The method of claim 1, wherein the cold-formed shape, after being subjected to the post-forming annealing cycle, comprises a microstructure substantially similar to a microstructure of standard Ti 6-2-4-2 sheet that has been duplex annealed according to AMS 4919 specifications.

3. The method of claim 1, wherein the cold-formed shape, after being subjected to the post-forming annealing cycle, comprises mechanical properties substantially equivalent to mechanical properties of standard Ti 6-2-4-2 sheet that has been duplex annealed according to AMS 4919 specifications.

4. The method of claim 1, wherein the cold-formed shape comprises a higher volume percent of beta phase therein than standard Ti 6-2-4-2 sheet that has been duplex heat treated according to AMS 4919 specifications.

5. The method of claim 1, wherein the cold-fonned shape comprises about 18 percent to about 40 percent more beta phase therein by volume than standard Ti 6-2-4-2 sheet that has been duplex heat treated according to AMS 4919 specifications.

6. The method of claim 1, wherein the cold-formed shape comprises less fine $\alpha_2$ or less silicides than in standard Ti 6-2-4-2 sheet that has been duplex heat treated according to AMS 4919 specifications.

7. The method of claim 1, wherein the cold-formed shape comprises less fine $\alpha_2$ and less silicides than in standard Ti 6-2-4-2 sheet that has been duplex heat treated according to AMS 4919 specifications.

8. The method of claim 1, wherein the cold-formed shape can be cold-formed to a final, permanent 90° bend angle having a bend factor of less than about 14 T.

9. The method of claim 8, wherein the cold-formed shape can be cold-fonned to a final, permanent 90° bend angle having a bend factor of about 6.2 T or greater.

10. The method of claim 1, wherein the cold-formed shape comprises a gas turbine engine component.

11. The method of claim 10, wherein the gas turbine engine component comprises at least one of: a nozzle sidewall, a flap, a duct, a case, and a bracket.

* * * * *